United States Patent [19]

Huang

[11] Patent Number: 5,042,333

[45] Date of Patent: Aug. 27, 1991

[54] ADAPTER SLEEVE

[76] Inventor: Daniel Huang, 9-1, Lane 161, Hsing An Rd., Sec. 1, Taichung, Taiwan

[21] Appl. No.: 663,732

[22] Filed: Mar. 4, 1991

[51] Int. Cl.[5] ..... B25B 15/00; B25B 23/00

[52] U.S. Cl. ..... 81/438; 81/125; 279/102

[58] Field of Search ..... 81/438, 439, 121.1, 81/125, 452; 279/79, 102

[56] References Cited

U.S. PATENT DOCUMENTS 4,325,153 4/1982 Finnegan ..... 81/438 X 4,644,831 2/1987 Yang ..... 81/125

*Primary Examiner*—D. S. Meislin

[57] ABSTRACT

An improved adapter sleeve comprises a cylinder-shaped adapter sleeve which has a lower adapter and an upper adapter. The lower adapter has a square recess hole, and the upper adapter has a hexagonal recess hole. The bottom surface of the upper adapter includes a rectangular surface and two symmetrically inclined triangular surfaces. The rectangular surface is disposed between the two inclined triangular surfaces. The angle between the retangular surface and each of the two triangular surfaces is no more than 45° and no less than 5°.

1 Claim, 4 Drawing Sheets

ADAPTER SLEEVE

BACKGROUND OF THE PRESENT INVENTION

The present invention relates to an adapter sleeve and more particularly to an improved adapter sleeve which comprises two triangular inclined surfaces to protect the base portion of a generally U-shaped elastic clamp.

Referring to FIG. 1, a conventional adapter sleeve 1 with a hollow interior 2 comprises a horizontal inner surface 3. A generally U-shaped elastic clamp 20 is inserted into the interior 2 of the adapter sleeve 1. The middle portion of the two arms of the adapter sleeve 1 are slightly concave respectively. The two arms are connected by a base portion 201 to form a U-shaped clamp 20. When the U-shaped elastic clamp 20 is inserted into the sleeve 1, the base portion 201 of the clamp 20 contacts the horizontal inner surface 3 so that the clamp 20 is positioned by the inner periphery and the inner surface 3 of the sleeve 1. A screw driver (not shown in FIG. 1) is inserted into the sleeve 1, and then the screw driver is secured by the U-shaped elastic clamp 20 tightly.

Since the base portion 201 of the clamp 20 abuts both the sleeve 1 with its lower surface and the screw driver with its upper surface respectively, the clamp 20 will be deformed or damaged if the sleeve 1 is continuously impacted by an electric tool or a high speed tool or is intermittently impacted by a pneumatic tool or other impact tools. The high impact force tools connected to the bottom end of the sleeve 1 may damage or deform the U-shaped clamp 20 after a period of usage. After a U-shaped clamp 20 is deformed or damaged, the screw driver cannot be released from the sleeve. Sometimes a screw driver cannot be secured tightly by a deformed U-shaped clamp 20. In one word, continuous or intermittent impact will damage or deform the U-shaped clamp sooner or later. Therefore, the deformed U-shaped clamp in the sleeve becomes useless.

SUMMARY OF THE PRESENT INVENTION

The main object of the present invention is to provide an improved adapter sleeve with two symmetrically inclined triangular surfaces so that a screw driver will not touch the base portion of a U-shaped elastic clamp.

A further object of the present invention is to provide two symmetrically inclined triangular surfaces in order to support a screw driver.

In order to achieve the above objects, the inclined triangular surfaces should be limited to a certain extent which will be described in the following preferred embodiment. Since the U-shaped elastic clamp does not touch the bottom of the screw driver, the U-shaped clamp will not be deformed nor damaged after a long period of usage under the condition of continueous impact or intermittent impact. However, the perpendicular distance between the horizontal surface and the highest vertex should be larger than the width of the U-shaped clamp.

DESCRIPTION OF THE PREFERRED EMBODIMENT

Figure 1:
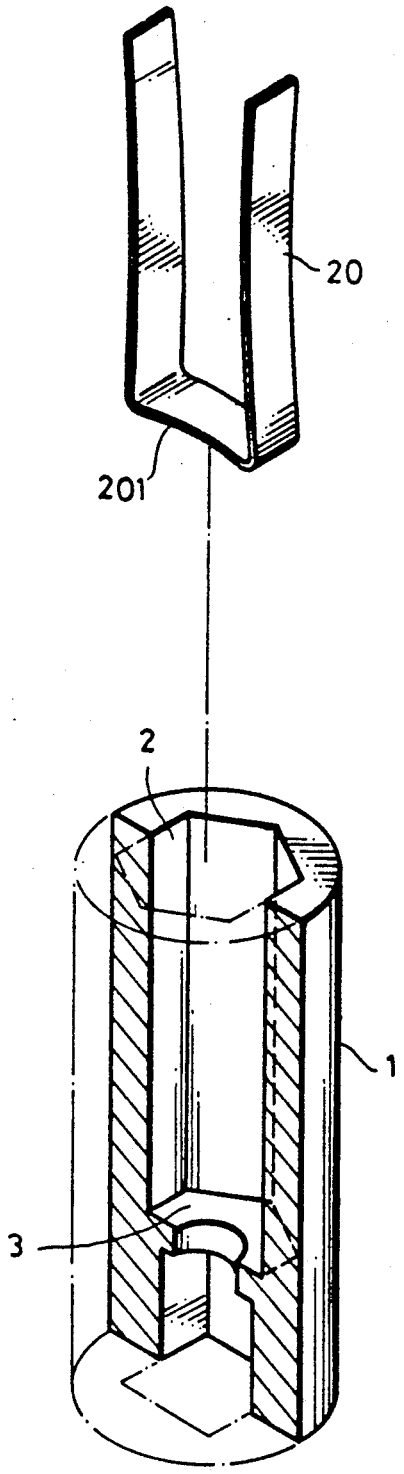
PRIOR ART FIG. 1
FIG. 1 is a perspective sectional view of a conventional adapter sleeve.
Figure 2:
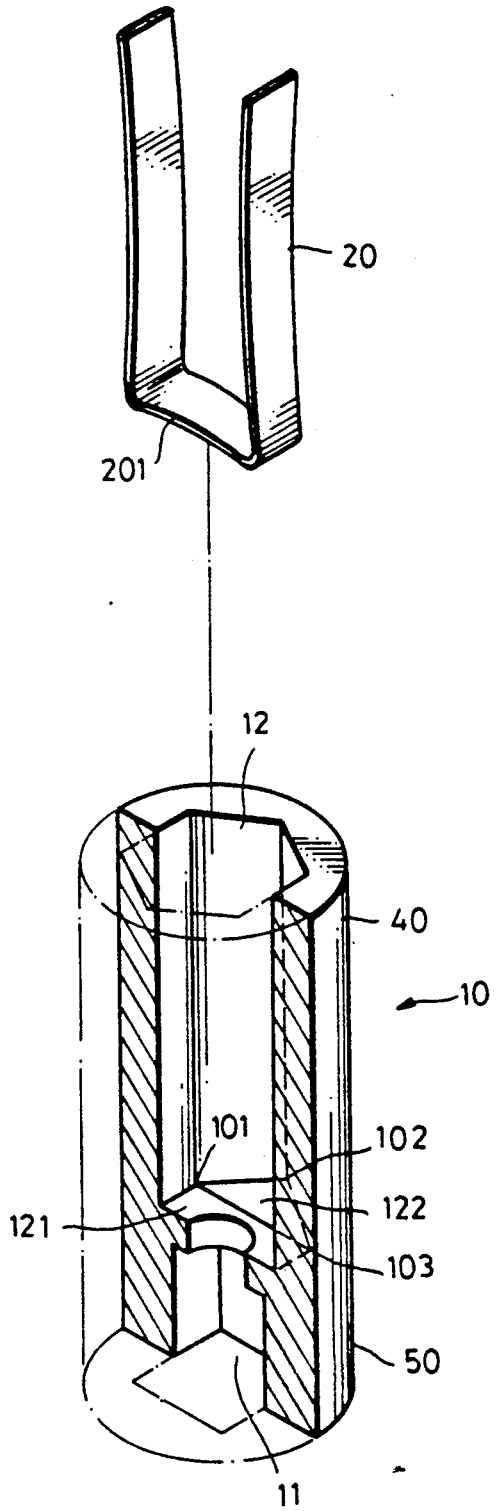
FIG. 2 is a perspective sectional view of an adapter sleeve of a preferred embodiment in accordance with the present invention.
Figure 3:
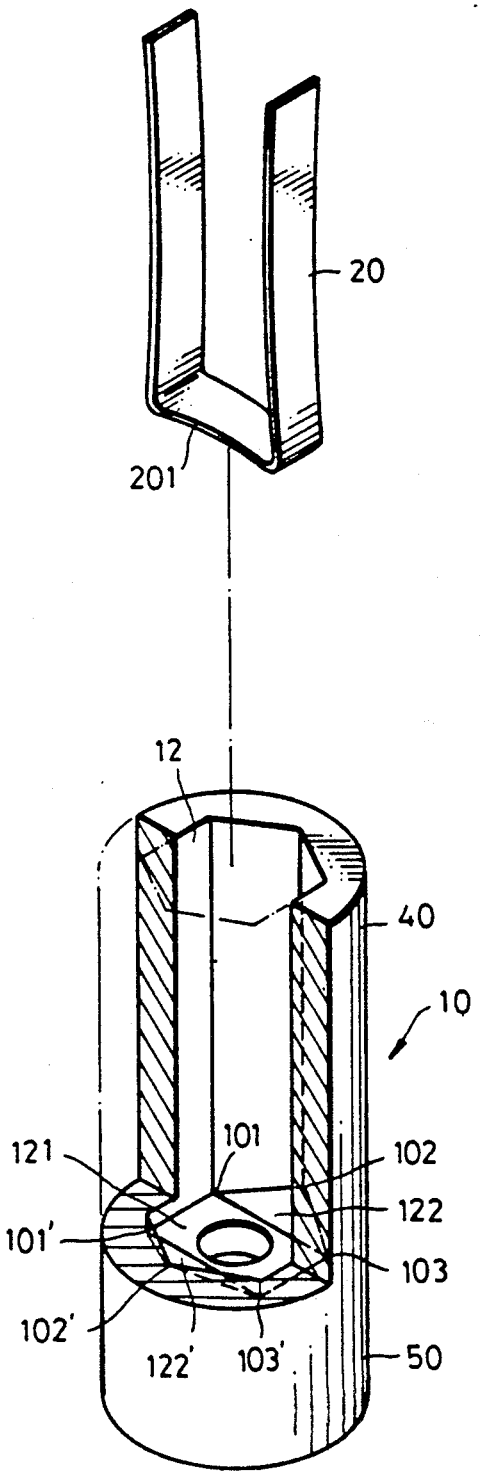
FIG. 3 is another perspective sectional view of an adapter sleeve of FIG. 2.
Figure 4:
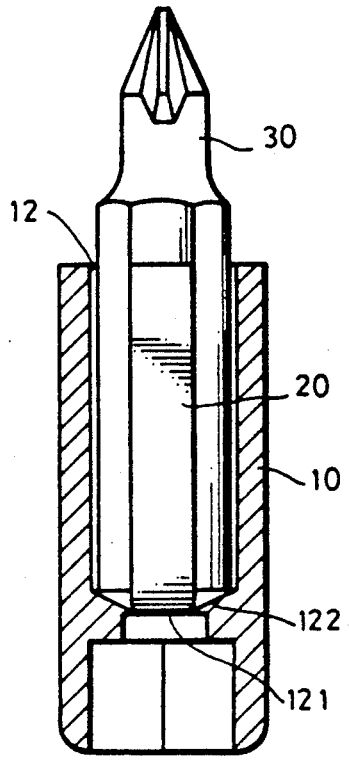
FIG. 4 is a cross-sectional, schematic view of an adapter sleeve and a screw driver in accordance with the present invention.
Figure 5:
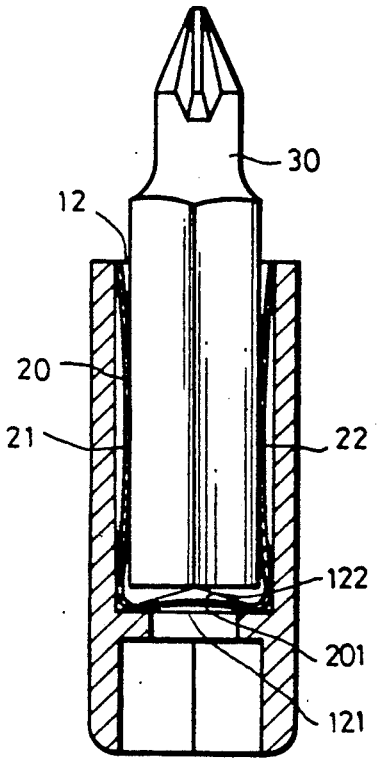
FIG. 5 is another cross-sectional, schematic view of an adapter sleeve and a screw driver in accordance with the present invention.

Referring to FIGS. 2 to 5, an improved adapter sleeve 10 is in a cylinder shape with a square recess hole 11 in the lower central interior and with a hexagonal recess hole 12 in the upper central interior. The upper portion of the sleeve 10 is called an upper adapter 40. The lower portion of the sleeve 10 is called a lower adapter 50. A generally U-shaped elastic clamp 20 is inserted into the hollow interior of the upper adapter 40 in order to clamp a screw driver 30. The bottom surface of the upper adapter 40 includes a rectangular surface 121 and two symmetrically inclined triangular surfaces 122 and 122'. The rectangular surface 121 is disposed between the two triangular surfaces 122 and 122'. The first inclined triangular surface 122 has three vertices 101, 102 and 103. The second inclined traingular surface 122' has three vertices 101', 102' and 103'. The rectangular surface 121 has four vertices 101, 101', 103 and 103'. The angle between the two surfaces 121 and 122, or 121 and 122' should be no more than 45° and no less than 5°. Since the two inclined triangular surfaces 122 and 122' are symmetrical, each of the two vertices 102 and 102' becomes the highest vertex of each inclined triangular surface 122 or 122' respectively. The vertical distance between the vertex 102 and the surface 121 should be larger than the width of the U-shaped elastic clamp 20. The vertical distance between the vertex 102' and the surface 121 should be larger than the width of the U-shaped elastic clamp 20 also. Thus the lower surface of the base portion 201 of the clamp 20 touches the rectangular surface 121, but the upper surface of the base portion 201 of the clamp 20 will not touch the bottom of a screw driver 30 which is inserted into the hollow interior of the upper adapter 40 also. The sides of the screw driver 30 are positioned by two slightly concave arms 21 and 22 so that the screw driver 30 can be secured in the upper adapter 40 without rotation between the screw driver 30 and the upper adapter 40.

Therefore, the bottom surface of the upper adapter 40 of the present invention is totally different from that of a conventional upper adapter. The bottom surface of a conventional upper adapter is in a flat, horizontal and hexagonal shape. Thus the bottom of a U-shaped elastic clamp 20 abuts the bottom of a screw driver. When the screw driver is pulled up, the U-shaped elastic clamp 20 may be pulled up also. The U-shaped clamp 20 may be damaged or deformed, if it is used for a high speed tool such as a pneumatic tool or an electric tool.

The bottom surface of the upper adapter 40 of the present invention is in three dimension. The upper adapter 40 with the three-dimensional bottom surface is used for protecting the U-shaped elastic clamp 20. Thus the features of the improved adapter sleeve of the present invention are superior to those of a conventional adapter sleeve.

I claim:

1. An improved adapter sleeve comprising:

a cylinder shaped adapter sleeve with a lower adapter and an upper adapter;

said lower adapter having a square recess hole;

said upper adapter having a hexagonal recess hole;

a bottom surface of said upper adapter including a rectangular surface and a first and a second symmetrically inclined triangular surface;

said rectangular surface disposed between said two inclined triangular surfaces;

an angle between said first triangular surface and said rectangular surface being no more than 45° and no less than 5°;

an angle between said second triangular surface and said rectangular surface being no more than 45° and no less than 5°.

* * * * *